US006667429B2

(12) United States Patent
Abe et al.

(10) Patent No.: US 6,667,429 B2
(45) Date of Patent: Dec. 23, 2003

(54) METHOD FOR MANUFACTURING MODIFIED WOOD

(75) Inventors: Hiroyasu Abe, Hamamatsu (JP); Junji Fujii, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 10/230,190

(22) Filed: Aug. 29, 2002

(65) Prior Publication Data

US 2003/0084962 A1 May 8, 2003

(30) Foreign Application Priority Data

Aug. 30, 2001 (JP) ..... 2001-262179
Aug. 2, 2002 (JP) ..... 2002-226633

(51) Int. Cl.[7] ..... G10D 1/00; B27M 1/00

(52) U.S. Cl. ..... 84/1; 34/259; 34/396; 144/271; 144/329; 144/361; 144/380; 428/106; 428/537.1

(58) Field of Search ..... 84/1, 275; 34/138, 34/259, 263, 265, 396; 144/329, 271, 361, 380; 428/106, 161, 537.1

(56) References Cited

U.S. PATENT DOCUMENTS 4,252,863 A * 2/1981 Song ..... 144/380 X
5,018,422 A * 5/1991 Coe, Jr. ..... 84/275
6,053,225 A * 4/2000 Yanai et al. ..... 144/361
6,083,437 A * 7/2000 Nishio et al. ..... 144/380 X
6,473,994 B1 * 11/2002 Dedieu et al. ..... 34/396

OTHER PUBLICATIONS

Hiroyuki Yano, et al., "Enhancement of the Physical Properties of Wood By Resorcin/Formaldehyde Treatment," The Journal Of Wood Science, vol. 38, 12, pp. 1119–1125(1992)—English Abstract and explanation of relevance.

Yoichi Saida, et al., Effect of Some Chemical and Physical Treatments on the Acoustic Properties of Woods, Forest Resources Environment, 39: pp. 37–49(2001)—English Abstract and explanation of relevance.

* cited by examiner

*Primary Examiner*—W. Donald Bray
(74) *Attorney, Agent, or Firm*—Dickstein, Shapiro, Morin & Oshinsky, LLP.

(57) ABSTRACT

Wood such as spruce, maple, and hornbeam are retained in high pressure steam of pressure 0.2 to 1.6 MPa at 120 to 200° C. for 1 to 60 minutes, and subsequently, cooled and dried to obtain a modified wood having superior acoustic properties and old wood-like appearance due to a change to a deep color tone. Since the conventional modification methods by chemical treatment using chemicals such as resorcin and formaldehyde are not used, the treatment steps are simple and a modified wood used as a material for musical instruments is obtained at low cost.

2 Claims, 11 Drawing Sheets

METHOD FOR MANUFACTURING MODIFIED WOOD

BACKGROUND OF THE INVENTION

1. Field of the Invention

The present invention relates to a method for manufacturing modified wood by high pressure steam treatment.

2. Description of Related Art

Conventionally, the modification of wood by various chemical treatments has been researched. For example, Hiroyuki Yano, et al. disclose in "The Journal of Wood Science, Vol. 38, No. 12, p. 1119–1125 (1992)" published by the Japan Wood Research Society that wood is modified by soaking in a resorcinol aqueous solution, air-drying the soaked wood, and heating the dried wood in formaldehyde vapor, and thereby, a decrease in loss angle (tan δ), an improvement of strength, a reduction in hygroscopicity, improvement of dimensional stability, and the like are achieved.

Furthermore, in addition to the above method, the following treatments are also carried out to modify wood: (1) formalization, (2) acetylation, (3) a treatment by low molecular weight phenol resin, (4) a treatment by resorcin-formaldehyde, and (5) a treatment by saligenin.

The treatment conditions therefor are as follows.

In the formalization, the agents used are tetraoxane and sulfur dioxide, and the treatment conditions are 24 hours at 120° C. In acetylation, the agent used is acetic anhydride, and the treatment conditions are 24 hours at 120° C. In the treatment by low molecular weight phenol resin, the agent used is low molecular weight phenol, and the treatment conditions are 48 hours (soaked in the low molecular weight phenol) at 160° C., and three hours for curing. In the treatment by resorcin-formaldehyde, the agents used are resorcin and paraformaldehyde, and the treatment conditions are 24 hours at 120° C. In the treatment by saligenin, the agent used is orthomethylolphenol, and the treatment conditions are 24 hours at 120° C.

However, the use of chemicals in any treatment method affects the environment and the human body. Furthermore, since the treatment steps are not simple and require a long time, costs are large. Moreover, in these methods, since a functional group is introduced into the cellulose in the wood or a resin or the like is filled into the cavities in the wood, the weight and density of the wood after treatment tends to increase. As the density of the wood increases, the conversion efficiency of sound decreases, and therefore, when the wood is used as a material for musical instruments, it can be a negative factor.

BRIEF SUMMARY OF THE INVENTION

An object of the present invention is to obtain a method for manufacturing modified wood, which is preferably used as a material for musical instruments, in which the treatment steps are simple, chemicals are not used, and the wood after treatment has good acoustic properties.

To solve the above problems, an aspect of the present invention is to provide a method for manufacturing modified wood comprising a step of retaining wood for 1 to 60 minutes under high pressure steam of 0.2 to 1.6 MPa at 120 to 200° C.

The optimum conditions for the high pressure steam treatment are determined by the desired degree of the treatment, the kind of wood, the dimensions of wood, and the like.

Furthermore, another aspect of the present invention is to provide a musical instrument made from the modified wood obtained by the above method as a soundboard or other parts.

According to the method of the present invention, since chemicals such as formaldehyde are never used, there is no effect on the environment or the human body. Furthermore, since treatment steps are simple and require a short time to complete, production costs are decreased.

Furthermore, since cellulose chains in the wood are partially hydrolyzed and rearranged, residual strain in the wood is resolved and the degree of crystallinity increases. Therefore, a modified wood having a superior dynamic modulus of elasticity (E) and oscillation properties such as damping factor of oscillation (tan δ) can be obtained. The above change is similar to the change in wood which occurs with the passage of time of some hundred years, therefore, it can be said that the modified wood of the present invention is antiquated in the above treatment.

Moreover, since the wood becomes dark brown by the above modification and the contrast of grain is increased, the modified wood can be developed with a transparent and deep appearance while the coating step can be shortened.

In particular, the above modified wood is preferably used as a material for musical instruments.

DETAILED DESCRIPTION OF THE INVENTION

The present invention is explained below in detail.

In the method for manufacturing the modified wood of the present invention, wood is held for 1 to 60 minutes in high pressure steam at a pressure of 0.2 to 1.6 MPa at 120 to 200° C. in order to modify the wood. For example, when a wood plate having thickness of 15 to 60 mm is treated in high pressure steam of 120 to 180° C. for 1 to 60 minutes, the effect appears. Most effectively, the wood plate is treated in high pressure steam of 160 to 180° C. for 8 to 30 minutes to be effectively modified.

As high pressure steam treatment methods, there are, for example, a method for putting raw wood in an autoclave having a high pressure steam atmosphere, a method for putting wood after shaping to a dimension in an autoclave having a high pressure steam atmosphere, and the like.

Figure 1:
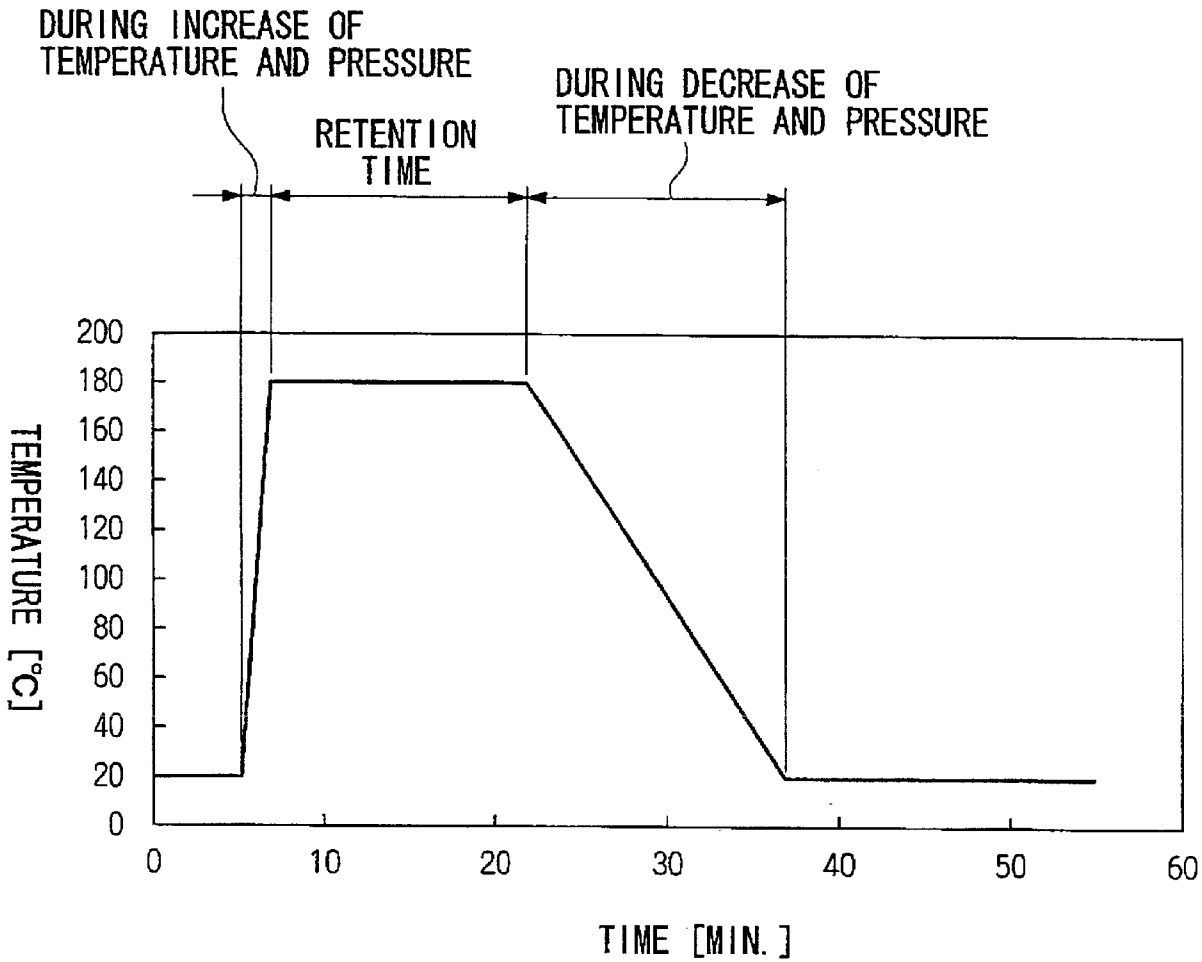
FIG. 1 is a graph showing a typical example of the temperature setting with respect to the time of high pressure steam treatment according to the present invention.

FIG. 1 shows a typical example of the setting temperature with respect to the time of the high pressure steam treatment for maple having a thickness of 20 mm. The retention time of the present invention indicates the time except for the period during increase and decrease of temperature and pressure, as an example shown in FIG. 1.

The high pressure steam contains a large amount of active species such as hydrogen ions, hydroxide ions, hydrogen radicals, and hydroxide radicals, and hydrolyzes cellulose, hemicellulose, and lignin which are main components of wood. When wood is put under the above conditions, the above active species are impregnated into the wood with the steam, and subsequently, hydrolyze hemicellulose, partially repolymerize lignin, decompose amorphous portions of cellulose and rearrage the decomposed portion. Accordingly, residual strain in the wood is resolved, and the degree of crystallinity and the width of micells increases. As a result, the dynamic modulus of elasticity (E) increases and the loss angle (tan δ) decreases. Furthermore, since a part of the decomposed component and extracted component of the wood is removed with water, density (ρ) decreases.

Therefore, in the obtained modified wood, since sound conversion efficiency, which is described by the product of the sound radiation attenuation (external attenuation efficiency) and the inverse of the internal attenuation efficiency of the material, shown below increases, the modified wood can be used as a material for musical instruments having superior oscillation properties.

$$\sqrt{E/\rho^3} \cdot \frac{1}{\tan\delta} \tag{0}$$

E is a Young's modulus of material, ρ is a density of material, and tan δ is loss angle by vibration.

The modified wood of the present invention can be used as a material for musical instruments, particularly, the soundboard and members of bowed stringed instruments such as violins, violas, cellos, and double basses; the soundboard and members of pluck stringed instruments such as acoustic guitars, electric guitars, harps, kotos, taisho-kotos, cembalos; the soundboard and members of struck stringed instruments such as pianos; bars of marimbas, xylophones, and the like, the bodies of drums, Japanese drums, and the like, members, and main bodies of woodblocks, wooden clappers, and the like in percussion instruments; and the main bodies and members of wood wind instruments in wind instruments, and as any wood part used to form musical instruments.

Furthermore, since the modified wood according to the present invention is imparted with a deep color tone, the coating step(s) can be shortened and a specific appearance and deep color, which are not present in untreated wood, are obtained. In addition, the modified wood can be obtained with an appearance of old wood for which several hundreds of years have passed since manufacturing.

The wood to be used as the material of the present invention is not limited, suitable wood is selected in response to the purpose of the modified wood to be obtained. For example, wood materials such as the natural wood of spruce, maple, and hornbeam; and plywood using natural wood as veneer can be used.

The wood retaining with the high pressure steam is treated by slowly decreasing the pressure and the temperature to room pressure and temperature so that the wood does not break due to pressure differences between inside and outside of the wood, and subsequently, the wood is treated by a drying step. The drying step is carried out by a known method for drying wood such as air-drying, heating-drying, and heating and decompression-drying, or a combination thereof. Furthermore, the desired moisture content is determined in response to the purpose of the modified wood being obtained, in particular, the moisture content is preferably set at 5 to 15% by weight.

As described above, according to the method for manufacturing modified wood according to the present invention, there is no effect on the environment or the human body because there are no chemicals used at all. Furthermore, the method requires only extremely simple steps in which conventional wood is treated by the high pressure steam treatment before a usual drying step, and therefore, the treatment of the wood is completed in a short time and production costs are decreased.

In the present invention, if the temperature (pressure) is constant, the degree of the treatment of the treated wood will advance according to the length of time. In addition, even if the treatment is carried out for the same length of time, differences in the degree of the treatment will occur due to the type and size of the wood material. For example, if two materials from the same tree having respective thickness, width, and length is double size of the other which is a rectangular parallelepiped of a certain size are treated for the same length of time, the treatment of the former becomes slower, and in order to obtain the degree of the treatment identical to that of the latter material, the treatment requires a length of time that is two or more times greater.

One method of quantitatively evaluating the degree of the treatment is the technique of measuring the amount of change in color of the material. The manner how the treatment advances depending on the retention time and whether differences appears in the degree of treatment depending on the dimensions of the material were examined and are shown below.

Two types were examined by dividing trees into broad leave trees and coniferous trees.

The measurement of the color of the wood material was carried out by spectrophotometry using a D65 light source (10° field), and the measurement values were obtained as an LAB standard colorimetric system. The LAB standard colorimetric system is a standard color system that represents colors as positions in a three dimensional coordinate system (L axis: luminosity; A axis and B axis: hue), and difference ΔE (color difference) is the distance between two color positions in the coordinate. The color difference ΔE of the material before and after treatment was used as the amount of color change of the material. After completion of the treatment the material is cut at its center of the lengthwise direction (along grain) perpendicular to the direction of the grain, and the center of the cut surface was measured. The color values of the material before treatment are substituted by measuring the same position of a material next to the material from the same log (lumber) (untreated material)

Figure 2:
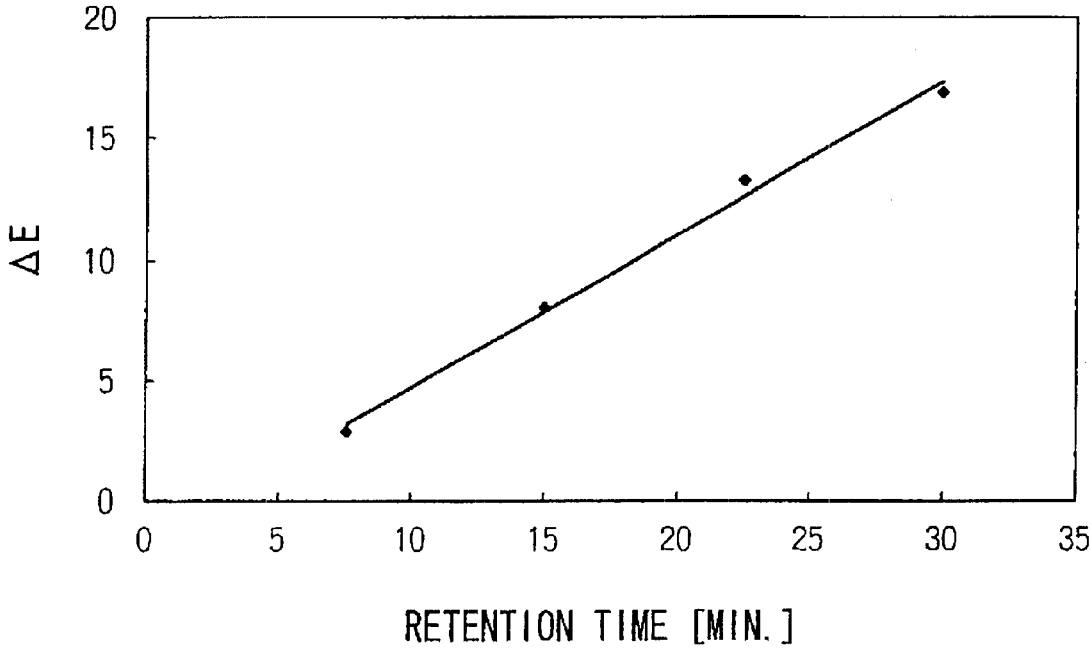
FIG. 2 is a graph showing a retention time and a change in color of hornbeam (Carpinus) at a treatment temperature of 170° C.

First, the result for the broad leave trees will be explained. FIG. 2 shows the relationship between the retention time of the broad leave tree (hornbeam material) and the change in the color of the material. The treatment temperature at this time is 170° C., and the shape of the end grain of the material was a rectangular parallelepiped with edge lengths of 15 mm and a length of 200 mm. From FIG. 2 the longer the retention time the more the degree of the treatment has advanced being the larger the amount of change of the color of the material, and within the measured range, it can be said that the slope formed by the retention time and the change in the color of the material is a positive linear relationship.

Figure 3:
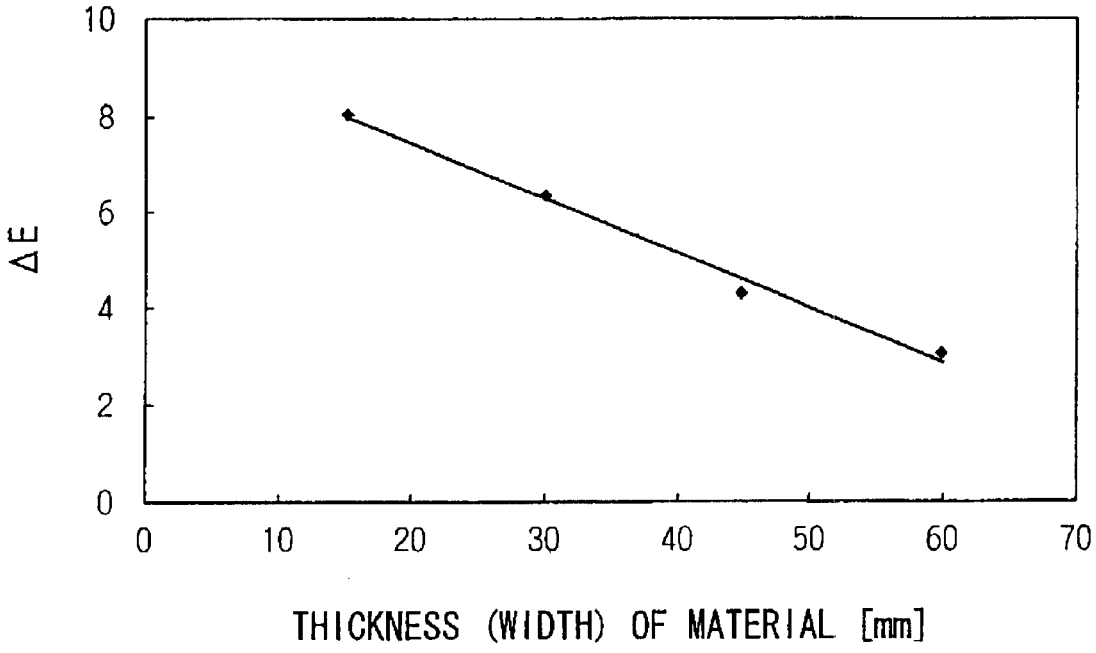
FIG. 3 is a graph showing a thickness of a material and the change in color of hornbeam (Carpinus) at a treatment temperature of 170° C. and a retention time of 15 minutes.

FIG. 3 shows the relationship between the length of the edge (thickness=width) of the end grain (square) and the change in color of the material. The treatment conditions at this time are that the temperature is 170° C., the retention time was 15 minutes, the material is a broad leave tree (hornbeam material), and the shape of the material is a rectangular parallelepiped having a length of 200 mm. According to the graph, within the measured range, it can be said that the slope formed by the length of the edge of the grain end cross section (square) and the change in the color of the material is a negative linear relationship, and it can be understood that the longer the length of the edge of the cross section, the slower the treatment advances. Moreover, experiments were carried out using materials having different thicknesses and widths, but when the degree of treatment was compared with the same material in which the dimensions of the thickness and width were reversed, no difference was observed, and it can be said that the change of the degree of treatment from the thickness change and the width change are the same.

Figure 4:
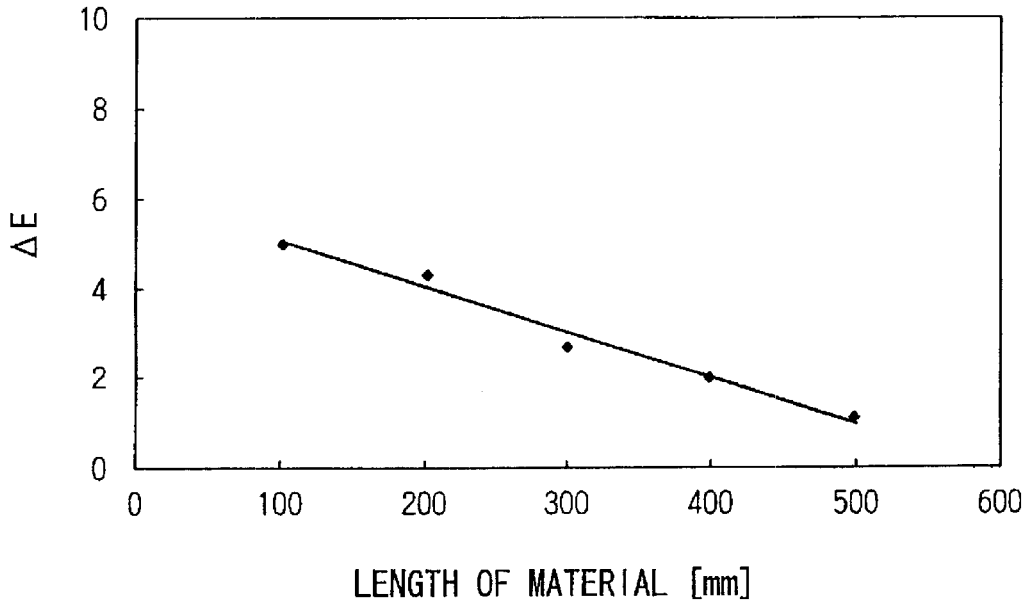
FIG. 4 is a graph showing a length of a material and the change in color of hornbeam (Carpinus) at a treatment temperature of 170° C.

FIG. 4 shows the relationship between the length of the material and the change in the color of the material. Here, the grain end cross section of the material (rectangular parallelepiped) is a square whose edge is 45 mm, and the type of tree, the treatment conditions, the measurement location and the like are identical to the above. From FIG. 4, it can be said that in the measured range, the slope formed by the length of the material and the change in the color of the material is a negative linear relationship, and it can be understood that the longer the material, the slower the treatment advances, and time is required more in order for the degree of treatment to advance.

According to the above results, for the broad leave trees, when materials having different sizes (thickness, width, and length), by adjusting the retention time depending on the size difference, it is possible to attain a finish of a desired degree of the treatment.

Figure 5:
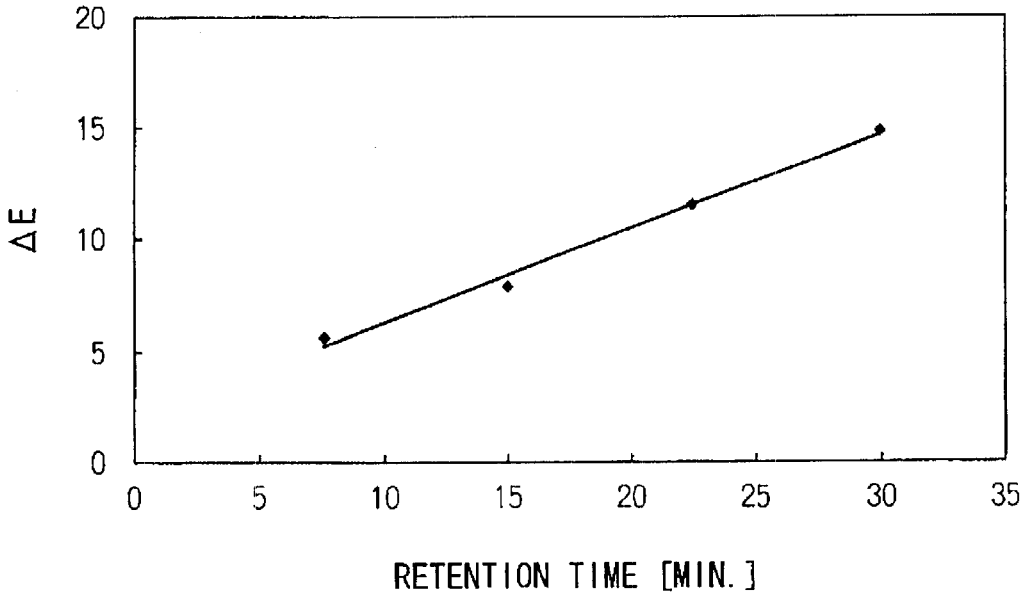
FIG. 5 is a graph showing the treatment time and the change in color of spruce (Picea) at a treatment temperature of 170° C.
Figure 6:
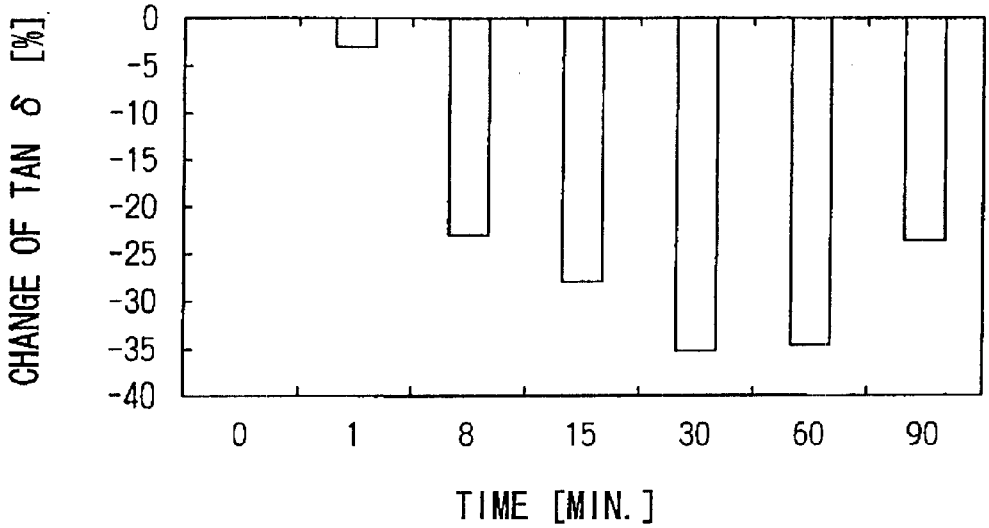
FIG. 6 is a graph showing the change in loss angle (tan δ) (%) with respect to the change in retention time before and after the high pressure steam treatment on hornbeam (Carpinus) at a retention temperature of 170° C.
Figure 7:
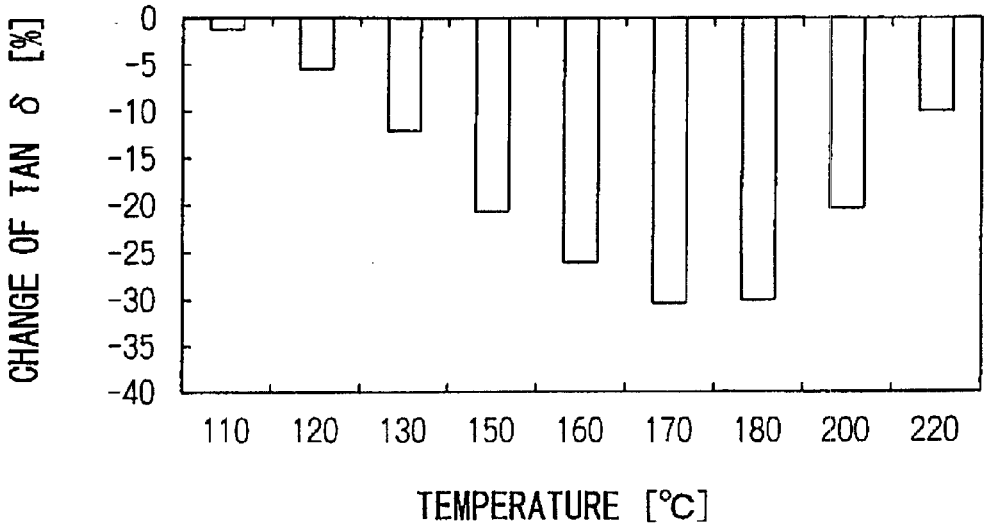
FIG. 7 is a graph showing the change in loss angle (tan δ) (%) with respect to the change of the retention temperature before and after the high pressure steam treatment on hornbeam (Carpinus) at a retention time of 30 minutes.
Figure 8:
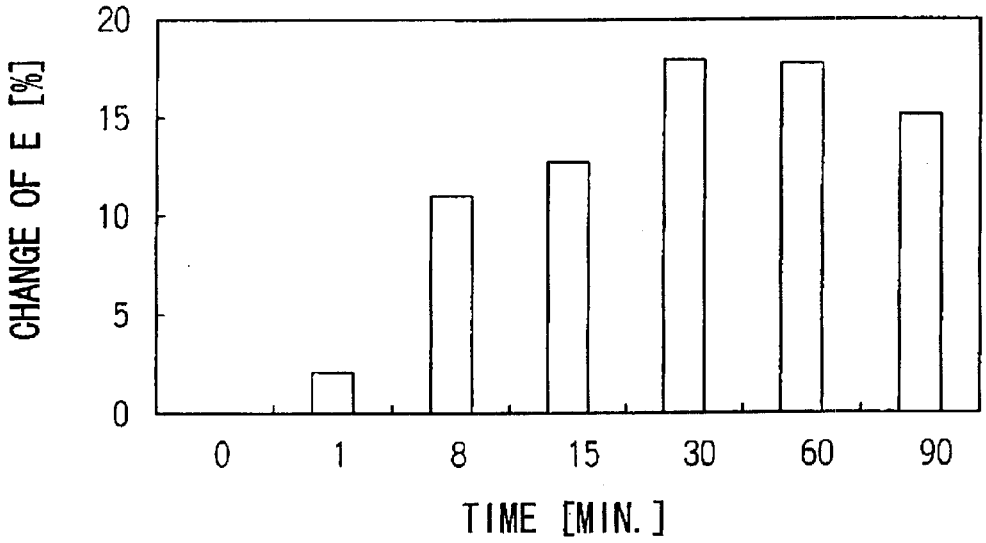
FIG. 8 is a graph showing the change in the dynamic modulus of elasticity (E) (%) with respect to the change in the retention time before and after the high pressure steam treatment on hornbeam (Carpinus) at a retention temperature of 170° C.
Figure 9:
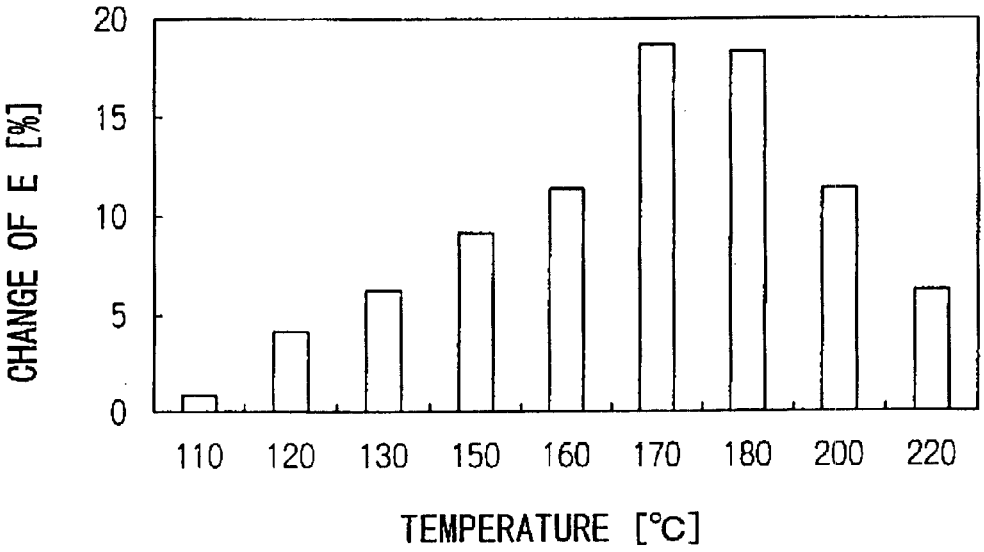
FIG. 9 is a graph showing the change in the dynamic modulus of elasticity (E) (%) with respect to the change in the a retention temperature before and after the high pressure steam treatment on hornbeam (Carpinus) at a retention time of 30 minutes.
Figure 10:
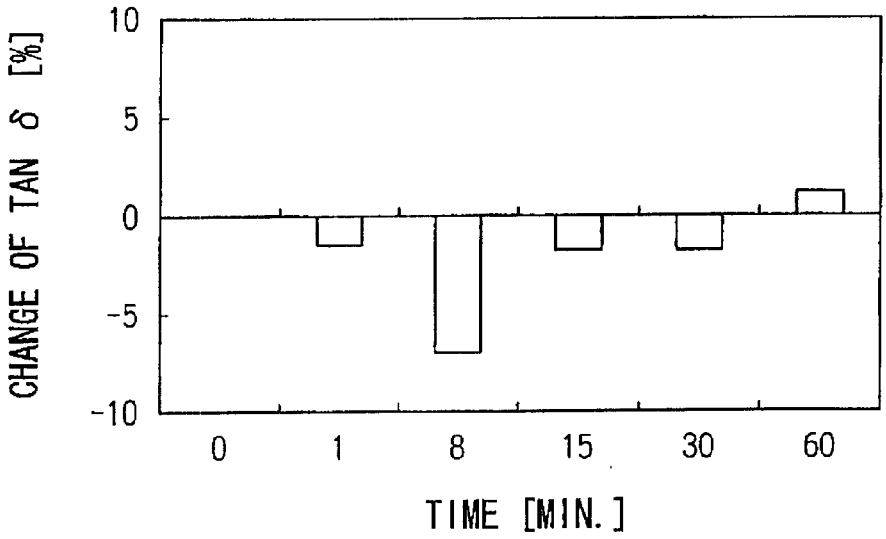
FIG. 10 is a graph showing the change in the loss angle (tan δ) (%) with respect to the change in the retention time before and after the high pressure steam treatment on spruce (Picea) at a retention temperature of 170° C.
Figure 11:
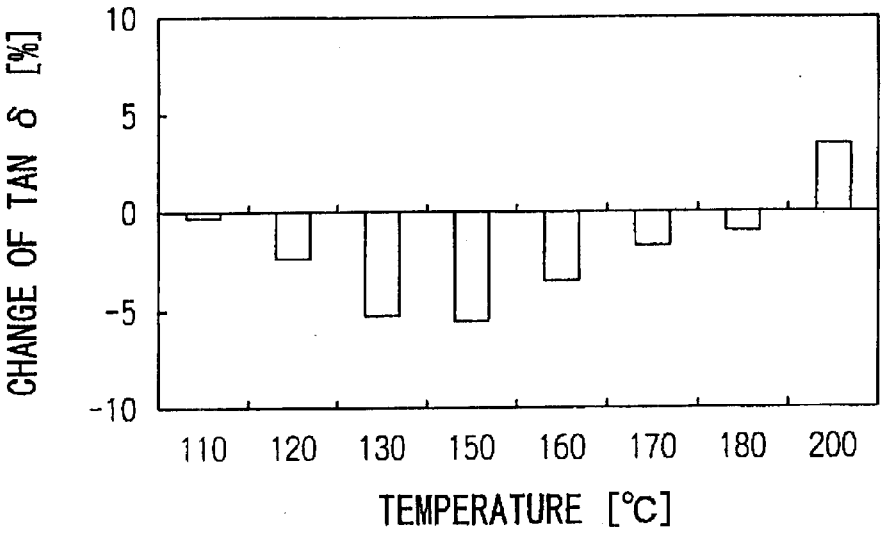
FIG. 11 is a graph showing the change in the loss angle (tan δ) (%) with respect to the change of the retention temperature before and after the high pressure steam treatment on spruce (Picea) at a retention time of 30 minutes.
Figure 12:
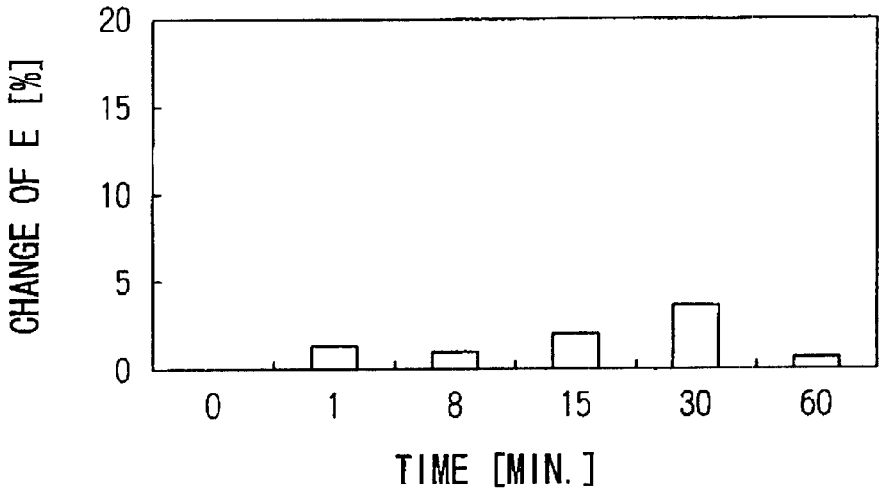
FIG. 12 is a graph showing the change in the dynamic modulus of elasticity (E) (%) with respect to the change in the retention time before and after the high pressure steam treatment on spruce (Picea) at a retention temperature of 170° C.
Figure 13:
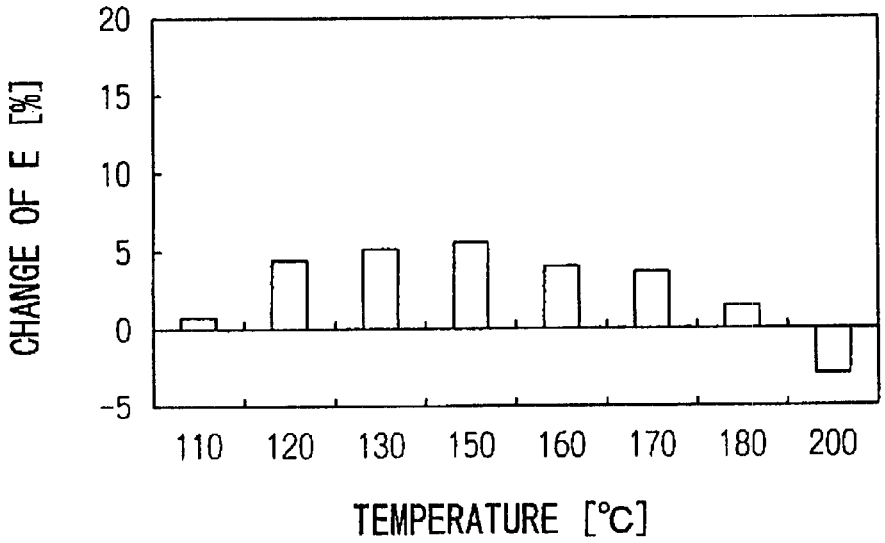
FIG. 13 is a graph showing the change in the dynamic modulus of elasticity (E) (%) with respect to the change in the retention temperature before and after the high pressure steam treatment on spruce (Picea) at a retention time of 30 minutes.

Next, the result for the coniferous trees will be explained. FIG. 5 shows the relationship between the retention time for the coniferous trees (spruce) and the change in the color of the material. Here, the treatment temperature is 170° C., and the shape of the material is a rectangular parallelepiped wherein the grain end cross-section with a length of 200 mm is a square having an edge of 15 mm. From FIG. 5, the longer the retention time, the more the treatment advances, the change in the color of the material becomes large, and it can be said that within the measured range the slope formed by the retention time and the change in the color of the material is a positive linear relationship.

For the coniferous trees (spruce) as well, like the case of the broad leave trees (hornbeam) described above, the relationship between the size of the treated material and the change in the color of the material were found, but there is not significant dependence of the degree of treatment on the dimensions that can be seen with the broad leave trees. As penetration of steam into materials having a low density, such as coniferous trees, is comparatively easy, it can be said that there is a tendency for the treatment to be carried out quickly into the inside of such coniferous trees.

In FIG. 2 and FIG. 5, when an approximately straight line is extrapolated to 0 minutes of the retention time, the intersection on the Y-axis is negative in FIG. 2 and positive in FIG. 5. This suggests that in a range (0 to 7.5 minutes) in which the retention time is short, the broad leave trees and the coniferous trees exhibit different behavior. This indicates that for the broad leave trees, the rise of the degree of treatment is slow, while contrariwise for the coniferous trees, it is fast.

The present invention is explained using an example as follows. The present invention is not limited to the following example.

EXAMPLE

Treatment Steps

Materials to be tested were treated by the following steps.

1. The material to be tested was prepared with a specific size.
2. The moisture content of the material to be tested was controlled at 20° C., 60% RH (relative humidity), and approximately 11% EMC (equilibrium moisture content).
3. Data of the material to be tested was measured before high pressure steam treatment.

4. The material to be tested was treated by a high pressure steam treatment.
5. The material to be tested was dried and the moisture content was controlled to 20° C., 60% RH, and approximately 11% EMC.
6. Data of the material to be tested was measured after high pressure steam treatment, As wood samples, hornbeam, and maple broad leave trees and spruce, a coniferous trees were used. Each wood sample was prepared with a wood plate which was a rectangular parallelepiped having a thickness of 15 mm, a width of 60 mm, and a height of 450 mm. The following items were measured for the wood samples.

Density

Thickness, width, and length were measured by digital vernier calipers to two decimal places (mm).

Weight was measured by an electronic balance to two decimal places (g).

Density was calculated using the measured thickness, width, length, and weight.

Oscillation properties

Oscillation properties were measured by a method of free—free beam vibrations.

The dynamic modulus of elasticity (E) in the fiber direction was calculated by Bernoulli-Euler's equation described below after measurement of the resonance frequency of free—free beam vibrations using an FFT analyzer.

Bernoulli-Euler's equation is:

$$EI\frac{\partial^4 y}{\partial x^4}+\rho A\frac{\partial^2 y}{\partial t^2}=0 \tag{1}$$

where

E: Young's Modulus of the material

ρ: density of the material

I: geometrical second moment of inertia

A: cross-sectional area of the material x: length direction of the material y: bending vibration direction t: time Thereby, the solution as a function of time (in the case that the boundary condition is free—free) is obtained:

$$2\pi f_n=\omega_n=\frac{m_n^2}{\lambda^2}\sqrt{\frac{EI}{\rho A}}\quad (n=0,1,2,3,\ldots) \tag{2}$$

where $f_n$: mode frequencies $\omega_n$: mode angular frequencies

λ: length of the material $m_n$: constants that determine the frequencies $m_n$ is found from the solution $\cos m_n \cosh m_n-1=0$, as a consequence of the function of x as a solution.

That is:

$m_0=4.73004$ $m_1=7.85320$ $m_2=10.99561$ $m_3=14.13717$ $m_4=17.27876$

From equation 2, equation 2' is obtained, and from equation 2' the Young's Modulus is found from the angular frequency of each vibration mode.

$$E=\frac{\rho A\lambda^4\omega_n^2}{Im_n^4} \tag{2'}$$

Loss angle (tan δ), which is vibration absorption efficiency ($Q^{-1}$), was calculated by Voigt model viscoelasticity theory described below after measurement of the logarithmic decrement of free—free beam vibrations using an FFT analyzer.

When the Voigt model viscoelasticity theory is applied to the Bernoulli-Euler's equation, the result is as follows:

$$EI\frac{\partial^4 y}{\partial x^4}+\eta I\frac{\partial^3 y}{\partial t\partial x^4}+\rho A\frac{\partial^2 y}{\partial t^2}=0 \tag{3}$$

where η is viscosity loss coefficient.

Thereby, when finding the solution (in the case that the boundary condition is free—free) as the function of time, the following is obtained:

$$T=T_0e^{-\frac{m_n^4\eta I}{2\lambda^4\rho A}t}\sin\sqrt{\frac{m_n^4EI}{\lambda^4\rho A}-\left(\frac{m_n^4\eta I}{2\lambda^4\rho A}\right)^2}\,t \tag{4}$$

where e is a base of natural logarithm.

If the inside of the square root is 0 (as shown below), then periodic motion (oscillation) does not occur. Here, η is called the critical loss coefficient $\eta_c$.

$$\frac{m_n^4EI}{\lambda^4\rho A}-\left(\frac{m_n^4\eta I}{2\lambda^4\rho A}\right)^2=\omega_q^2=0$$

That is, $$\eta_c=\frac{2\omega_n\lambda^4\rho A}{m_n^4I}=\frac{2E}{\omega_n} \tag{5}$$

In contrast, when the system given in equation (3) is forcibly oscillated, the following equation is obtained:

$$EI\frac{\partial^4 y}{\partial x^4}+\eta I\frac{\partial^5 y}{\partial t\partial x^4}+\rho A\frac{\partial^2 y}{\partial t^2}=P \tag{6}$$

where P is exciting force.

Thereby, by the solution (in the case that the boundary conditions is free—free) as the function of time, the following is obtained.

$$T_0=\frac{\lambda^4P_0}{EIm_n^4}=\frac{1}{\sqrt{\left(1-\frac{\omega^2}{\frac{m_n^4EI}{\lambda^4\rho A}}\right)+\left(\frac{\omega\eta}{E}\right)^2}} \tag{7}$$

Using equations (2) and (5), (7) is replaced with (7)' shown below.

$$T_0\simeq\frac{\lambda^4P_0}{EIm_n^4}=\frac{1}{\sqrt{\left(1-\frac{\omega^2}{\omega_n^2}\right)+\left(\frac{\omega}{\omega_n}\cdot\frac{2\eta}{\eta_c}\right)^2}} \tag{7'}$$

Note that $$Q\left(=\frac{1}{\tan\delta}\right)$$

is defined as $$Q=\left(\frac{T_0}{T_{st}}\right)_{\max}.$$

Here, $T_{st}$ is the amount of static bending of the beam due to the exciting force, shown in the following equation:

$$T_{st}=\frac{\lambda^4 P_0}{EIm_n^4} \tag{8}$$

The maximum amplitude of $T_0$ appears in equation (7)' when the denominator is at a minimum, and at this time, differentiating this denominator by $\omega/\omega_n$, it can be understood to be the following equation:

$$\frac{\omega}{\omega_n}=\sqrt{1-\left(\frac{\eta}{\eta_c}\right)^2} \tag{9}$$

Therefore, $$Q=\left(\frac{T_0}{T_{st}}\right)_{\max}=\frac{1}{\frac{2\eta}{\eta_c}\sqrt{1-\left(\frac{\eta}{\eta_c}\right)^2}} \tag{10}$$

In the case of a general material like wood, $$\left(\frac{\eta}{\eta_c}\right)^2$$

is very minute and is eliminated, and thereby, the following equation is obtained:

$$Q=\left(\frac{T_0}{T_{st}}\right)_{\max}\approx\frac{\eta_c}{2\eta} \tag{10'}$$

In addition, using equation (5):

$$\tan\delta=\frac{1}{Q}=\frac{\omega_n\eta}{E} \tag{10''}$$

In contrast, the logarithmic decrement Δ is:

$$\Delta=\log_e\frac{T_p}{T_p+1} \tag{11}$$

where p is an arbitrary positive integer.

Therefore, by equation (4), $$\Delta=\log_e\frac{e^{-\frac{\eta Im_n^4}{2\rho A\lambda^4}t}}{e^{-\frac{\eta Im_n^4}{2\rho A\lambda^4}\left(t+\frac{2\pi}{\omega_4}\right)}}=-\frac{\eta Im_n^4}{\omega_q\rho A\lambda^4}\pi \tag{11'}$$

In the case of a general material such as wood, because η is small, it is possible to consider $\omega_q=\omega_n$, and thus using equation (2), the following is obtained:

$$\Delta=\frac{\eta Im_n^4}{\omega_n\rho A\lambda^4}\pi=\frac{\omega_n\eta}{E}\pi \tag{11''}$$

and comparing equations (10)" and (11)", $$\tan\delta=\frac{1}{Q}=\frac{\Delta}{\pi} \tag{12}$$

is obtained, and the loss angle tan δ can be calculated if the logarithmic decrement Δ is found.

Ratio ($E_L/G_{LT}$) of the Modulus of elasticity $E_L$ and the modulus of rigidity $G_{LT}$: Using an FFT analyzer, the resonance frequencies from the mode 0 to mode 3 of the free—free beam vibrations were measured, and calculated using the consequences of the following Timoshenko's equation.

(Here, $E_L$, $G_{TL}$ are abbreviated E and G)

The Timoshenko's equation is:

$$EI\frac{\partial^4 y}{\partial x^4}+\rho A\frac{\partial^2 y}{\partial t^2}-I\rho\left(1+\alpha\frac{E}{G}\right)\frac{\partial^4 y}{\partial t^2\partial x^2}+\alpha\frac{I\rho^2}{G}\cdot\frac{\partial^4 y}{\partial t^4}=0 \tag{13}$$

where

G: transverse (shearing) modulus of elasticity

α: coefficient related to the shear (in the case of a rectangular cross-section, α=1.5)

Thereby, the solution (in the case that the boundary condition is free—free) as the function of time is:

$$2\pi f_n=\omega_n=\frac{m_n^2}{\lambda^2}\sqrt{\frac{EI}{\rho A}\cdot\frac{1}{1+\alpha\frac{E}{G}}}\quad(n=0,1,2,3,\ldots) \tag{14}$$

$m_n$ is a consequence of the solution as the function of x, and must be a value that satisfies equation (15):

$$2\frac{\gamma-\phi}{\beta+\phi}\sqrt{\frac{\beta}{\gamma}}\left(\cos\sqrt{\gamma}\lambda\cosh\sqrt{\beta}\lambda-1\right)+\left\{\frac{\beta}{\gamma}-\left(\frac{\gamma-\phi}{\beta+\phi}\right)^2\right\}\sin\sqrt{\gamma}\lambda\sinh\sqrt{\beta}\lambda=0 \tag{15}$$

Where:

$$\sqrt{\gamma}=\frac{m_n}{\lambda^2}\sqrt{\frac{m_n^2K^2+\sqrt{m_n^4K^4\left(1-\frac{4}{V}+\frac{4}{V^2}\right)+\frac{4}{V}\lambda^4}}{2}} \tag{16}$$

$$\sqrt{\beta}=\frac{m_n}{\lambda^2}\sqrt{\frac{-m_n^2K^2+\sqrt{m_n^4K^4\left(1-\frac{4}{V}+\frac{4}{V^2}\right)+\frac{4}{V}\lambda^4}}{2}} \tag{17}$$

and $$V=1+\alpha\frac{E}{G},\ K^2=\frac{I}{A},\ \phi=\alpha\rho\frac{\omega_n^2}{G}$$

When $\omega_n$ is a known by measurement, the available equations for the three unknowns $E_L$ (below, abbreviated E), $G_{LT}$ (below, abbreviated G), and $m_n$ are equation (14) and equation (15), and thus it is not possible to determine the values of these three. However, it is possible to represent G (or E/G) as a function of E.

When this function is derived for two mode angular frequencies, the intersection of these functions is considered to be the true value of G (or G/E) (actually, G can be found simply by combining two extracted from all the mode angular frequencies that are measured and the average value thereof is the true value).

It is noted that as can be understood from the above equations, in the case of the Timoshenko's equation, unlike the case of the Bernoulli-Euler's equation, even if the characteristics of the material are determined, if the dimensional values are not determined. $m_n$ is not determined. That is, the Timoshenko's equation is a system from which a scaling effect cannot be expected in the oscillation characteristics.

As described above, using the Timoshenko's equation, E and G (and therefore E/G) are calculated by measuring the dimensions of the material, the mass, and $\omega_n$.

Oscillation properties were measured in a room adjusted at 20° C. at 60% RH.

FIGS. 6 to 17 show the changes of material properties from results after the high pressure steam treatment.

As shown in FIGS. 8, 9, 12, and 13, the dynamic modulus of elasticity (E) tends to increase as retention time passes or temperature increases. The maximum change is 18% dynamic modulus of elasticity (E) of hornbeam in FIG. 9.

Furthermore, as shown in FIGS. 6, 7, 10, and 11, the loss angle (tan δ) tends to decrease as retention time passes or temperature increases. The maximum change is −35% loss angle (tan δ) in hornbeam in FIG. 6.

Figure 14:
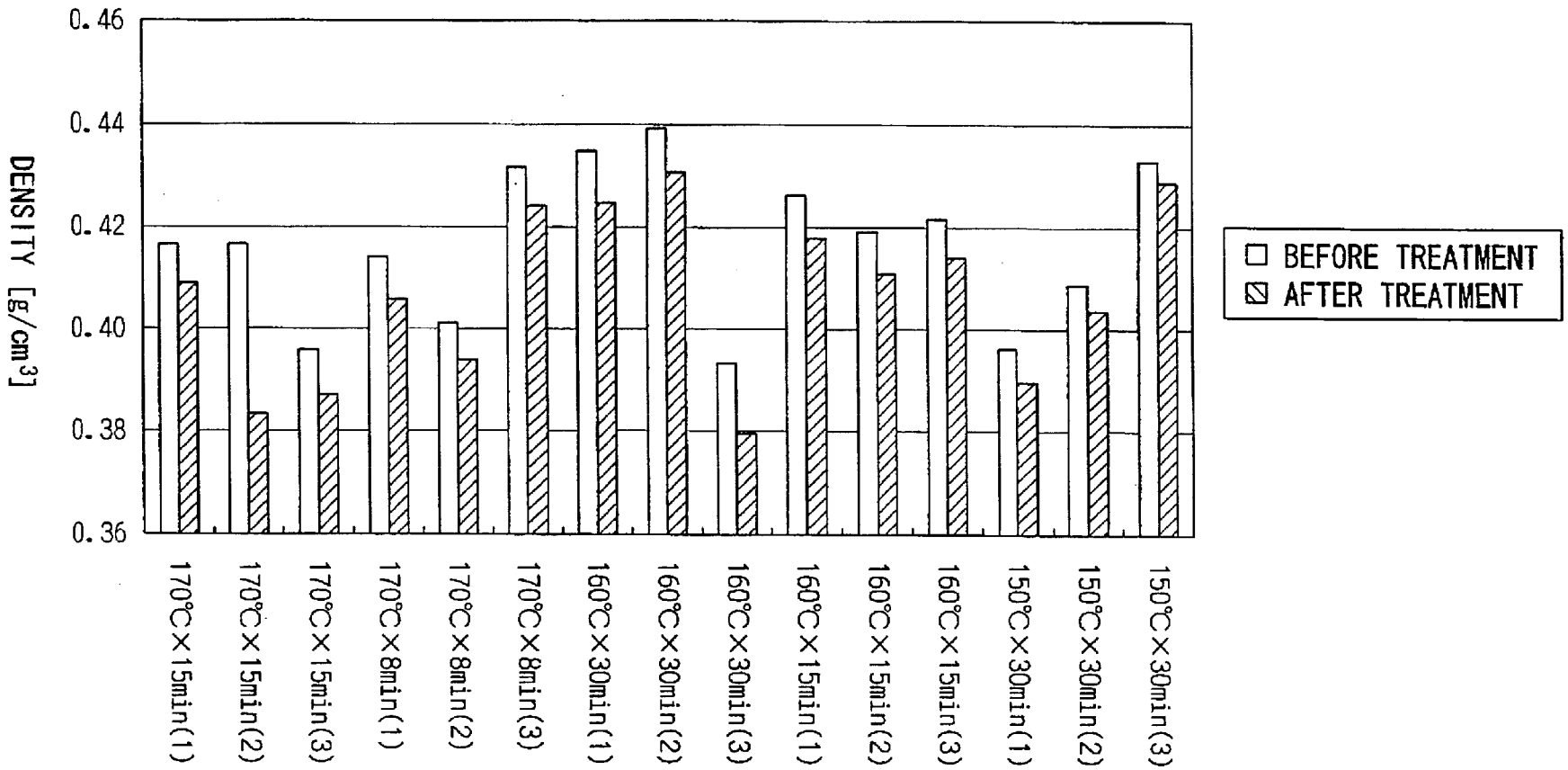
FIG. 14 is a graph showing the change in density before and after the high pressure steam treatment of spruce (Picea) under five types of condition at a retention temperature of 150 to 170° C. and a retention time of 8 to 30 minutes.
Figure 15:
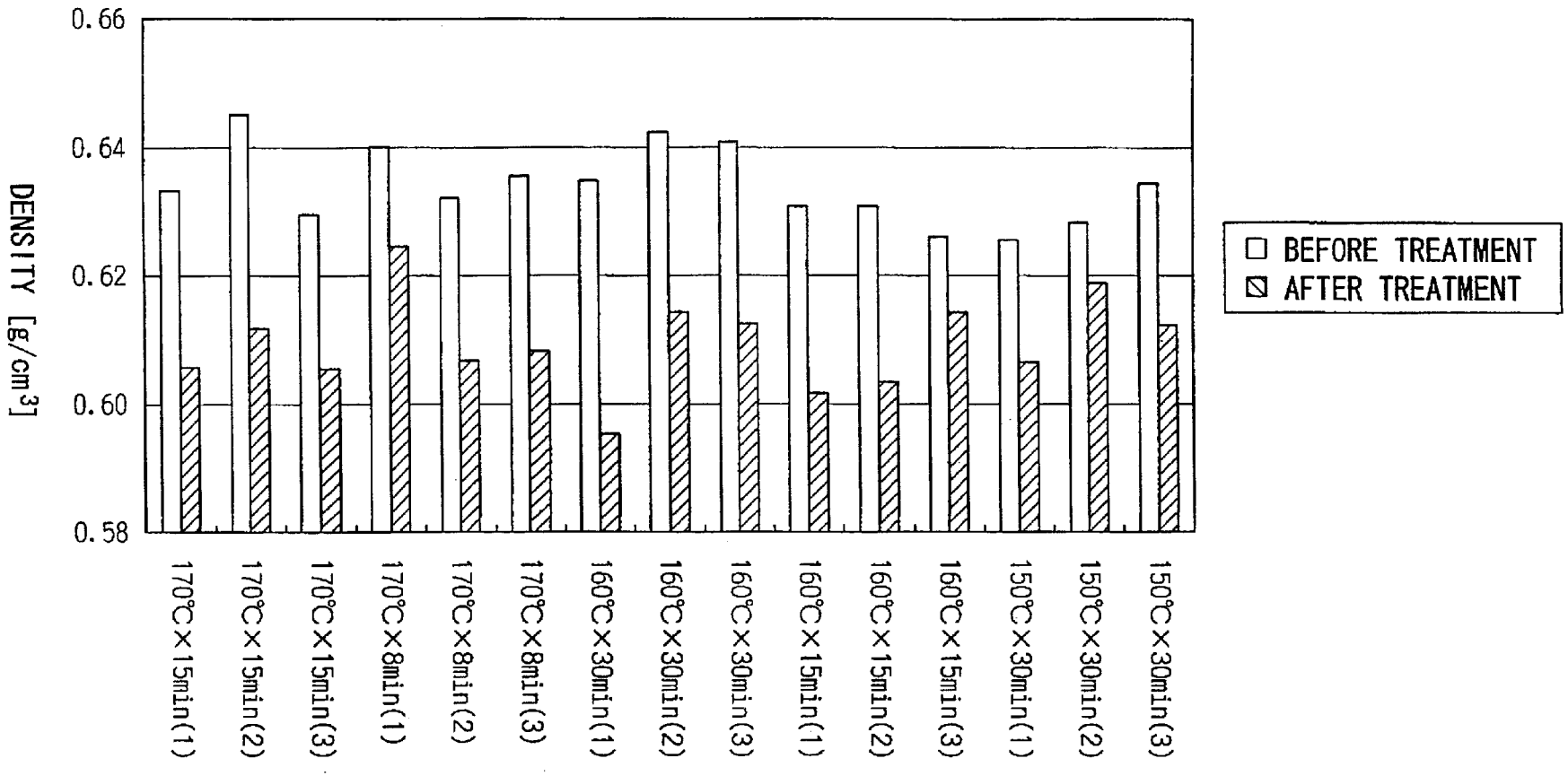
FIG. 15 is a graph showing the change in density before and after the high pressure steam treatment of maple under five types of condition at a retention temperature of 150 to 170° C. and a retention time of 8 to 30 minutes.

Furthermore, as shown in FIGS. 14 and 15, the density tends to decrease. The maximum change is −8% density in spruce.

Figure 16:
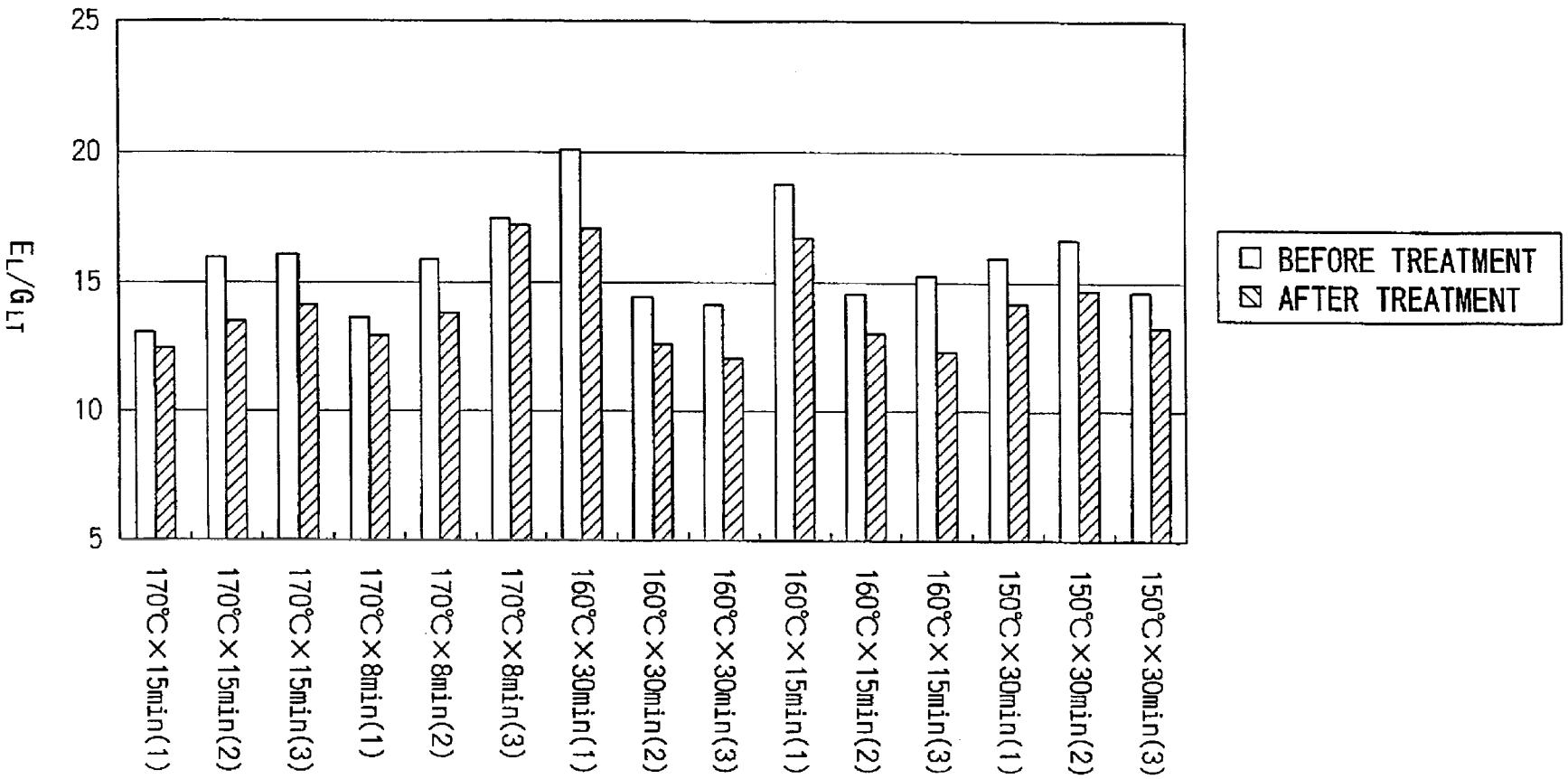
FIG. 16 is a graph showing the change in $E_L/G_{LT}$ before and after the high pressure steam treatment of spruce (Picea) under five types of condition at a retention temperature of 150 to 170° C. and a retention time of 8 to 30 minutes.
Figure 17:
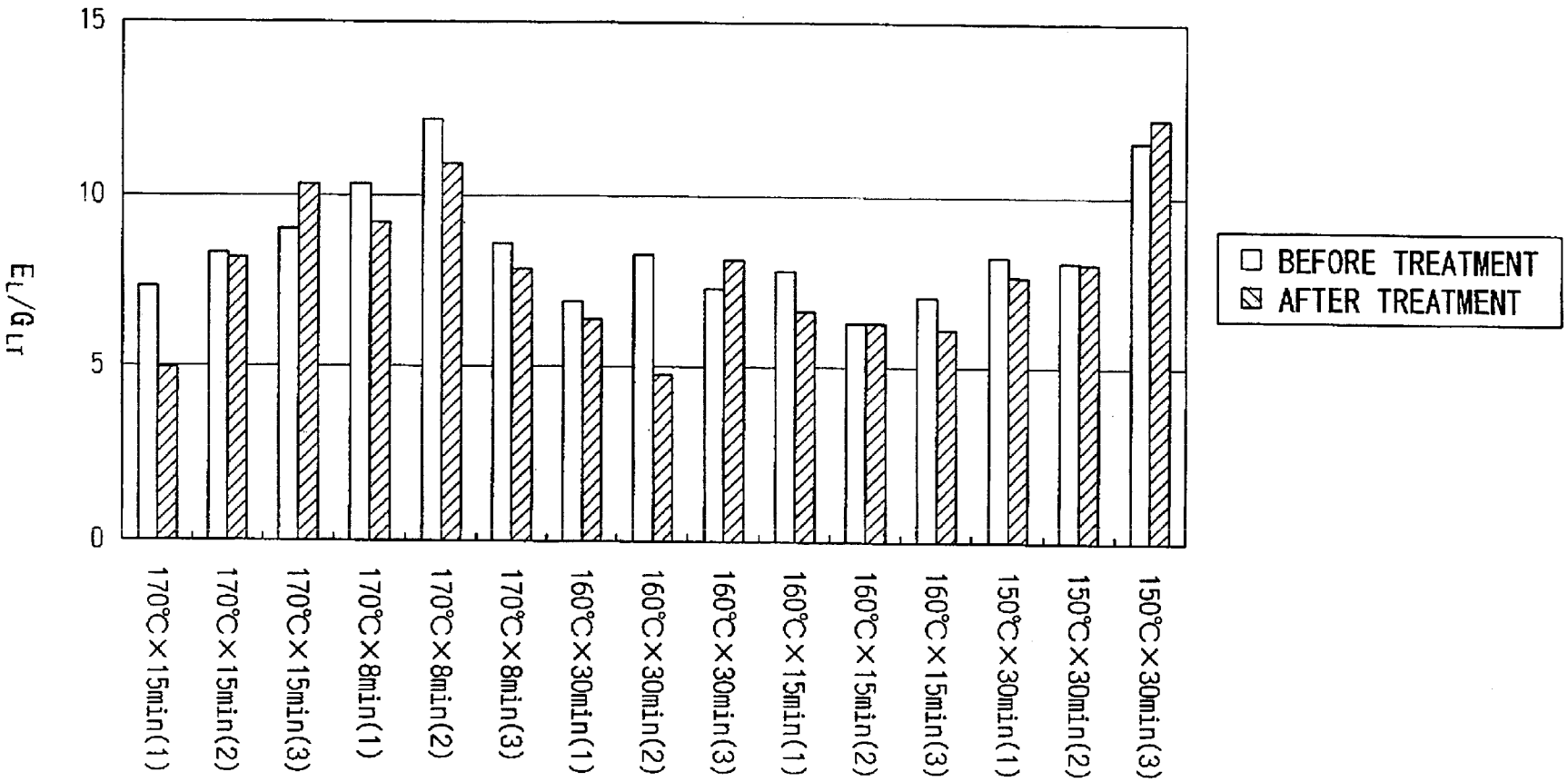
FIG. 17 is a graph showing the change in $E_L/G_{LT}$ before and after the high pressure steam treatment of maple under five types of condition at a retention temperature of 150 to 170° C. and a retention time of 8 to 30 minutes.

According to the high pressure steam treatment, the sound conversion efficiency of the wood is remarkably improved. The above change is similar to the change which occurs in the wood with the passage time of a few hundreds of years; therefore, it may be said that to produce the treated wood of the present invention is to make aged wood. As shown in FIGS. 16 and 17, $E_L/G_{LT}$ tends to decrease, therefore, strength of the wood is increased. It is a characteristic after the high pressure steam treatment.

Change in Color

The light brown colored wood turned into a dark brown colored wood with a good appearance and deep color tone due to the high pressure steam treatment. Since the color of wood changes, the coating step is shortened and the contrast in the grains is increased to improve the value of the appearance of the wood.

Change in Sound

By using the modified wood of the present invention as a material for musical instruments, the sound was changed as follows.

(a) Violin

Three violins were prepared using the modified wood (spruce and maple) according to the present invention as the soundboard and other members. Each violin was played by ten famous Japanese or non-Japanese violinists. As a result, each violin was highly evaluated with respect to volume, sound, and expression. In particular, the sound of the violins according to the present invention was similar to that of the old masters violins made in 1500s to 1700s extremely highly evaluated.

(b) Piano

Two pianos were prepared using the modified wood (spruce) according to the present invention as a soundboard. The pianos were compared with a piano prepared using untreated wood. Each piano was played by two famous players and was evaluated by 20 listeners. As a result, each piano using the modified wood was highly evaluated with respect to volume, sound, and expression. Furthermore, bridges prepared using the modified wood were incorporated in the above pianos, and each piano was evaluated similarly. As a result, each piano was highly evaluated with respect to volume, sound, and expression.

What is claimed is:

1. A method for manufacturing modified wood comprising a step of retaining wood for 1 to 60 minutes under high pressure steam of 0.2 to 1.6 MPa at 120 to 200° C.

2. A musical instrument including a body made at least partially of a modified wood made by retaining wood for 1 to 60 minutes under high pressure steam of 0.2 to 1.6 MPa at 120 to 200° C.

* * * * *